US006834404B2

(12) United States Patent
Fletcher

(10) Patent No.: US 6,834,404 B2
(45) Date of Patent: Dec. 28, 2004

(54) LIFTING AND LOWERING APPARATUS

(75) Inventor: Richard Edmond Fletcher, Herefordshire (GB)

(73) Assignee: Mangar International Limited, Presteigne (GB)

( * ) Notice: Subject to any disclaimer, the term of this patent is extended or adjusted under 35 U.S.C. 154(b) by 0 days.

(21) Appl. No.: 10/470,286

(22) PCT Filed: Mar. 28, 2002

(86) PCT No.: PCT/GB02/01226

§ 371 (c)(1),
(2), (4) Date: Nov. 6, 2003

(87) PCT Pub. No.: WO02/078590

PCT Pub. Date: Oct. 10, 2002

(65) Prior Publication Data

US 2004/0068796 A1 Apr. 15, 2004

(30) Foreign Application Priority Data

Mar. 30, 2001 (GB) ..... 0107999

(51) Int. Cl.[7] ..... A61G 7/012; B66F 3/24

(52) U.S. Cl. ..... 5/611; 5/11; 4/564.1; 254/93 HP

(58) Field of Search ..... 5/611, 11, 86.1, 5/81.1 R; 296/20; 4/564.1; 254/93 R, 93 L, 93 HP

(56) References Cited

U.S. PATENT DOCUMENTS 2,001,744 A * 5/1935 Patterson ..... 254/2 B
2,070,960 A * 2/1937 Phillips ..... 254/93 HP
2,610,824 A * 9/1952 Grier ..... 254/93 HP
2,725,578 A * 12/1955 Keller et al. ..... 4/565.1
3,174,722 A * 3/1965 Alm ..... 254/93 HP
4,159,822 A * 7/1979 Ota et al. ..... 5/614
4,188,677 A * 2/1980 Zur ..... 5/615
4,198,025 A * 4/1980 Lowe et al. ..... 248/550
4,319,666 A * 3/1982 Hunter ..... 187/204
4,323,141 A * 4/1982 Ragan et al. ..... 187/204
4,407,029 A * 10/1983 Schmidt ..... 4/564.1
4,419,776 A * 12/1983 Schmidt ..... 4/564.1
4,589,620 A * 5/1986 Sakamoto ..... 248/550
4,688,760 A * 8/1987 Garman et al. ..... 254/93 HP
4,786,032 A * 11/1988 Garman et al. ..... 254/93 HP
4,921,074 A * 5/1990 Ochs ..... 187/204
4,941,641 A * 7/1990 Granzow et al. ..... 248/588
5,022,105 A * 6/1991 Catoe ..... 5/11
5,096,160 A * 3/1992 Calico et al. ..... 254/93 HP
5,169,112 A * 12/1992 Boyles et al. ..... 248/550
5,176,355 A * 1/1993 Carter ..... 248/550
5,299,906 A * 4/1994 Stone ..... 187/275
5,346,170 A * 9/1994 Schmidt et al. ..... 248/550
5,419,534 A * 5/1995 Vesely ..... 254/9 C
5,490,758 A * 2/1996 Stone ..... 414/792.3
5,492,300 A * 2/1996 Riihiluoma et al. ..... 248/354.1
5,542,806 A * 8/1996 Kang ..... 414/422
5,598,591 A * 2/1997 Kelley ..... 5/118
5,735,509 A * 4/1998 Gryp et al. ..... 267/131
5,771,816 A * 6/1998 Zaguroli, Jr. ..... 108/147
5,799,922 A * 9/1998 Timms et al. ..... 248/564
5,979,605 A * 11/1999 Popp ..... 187/205
6,113,188 A * 9/2000 Stewart et al. ..... 297/339
6,264,163 B1 * 7/2001 Ivarsson ..... 248/588
6,286,812 B1 * 9/2001 Cherry ..... 254/9 C
6,654,973 B2 * 12/2003 Van Den Heuvel et al. .... 5/611
2002/0174486 A1 * 11/2002 Heuvel et al. ..... 5/611
2003/0180130 A1 * 9/2003 Lutz ..... 414/385
2004/0068796 A1 * 4/2004 Fletcher ..... 5/611

* cited by examiner

*Primary Examiner*—Robert G. Santos
(74) *Attorney, Agent, or Firm*—Notaro & Michalos PC

(57) ABSTRACT

Apparatus for lifting or/and lowering persons has two interconnected X-frames each with two pivotally connected members arranged in an upright position in spaced parallel relationship, a support supported by the members, and one of two inflatable bags surrounding the pivotal connections so that portions of the bags lie between members, whereby inflation and deflation of the bags, opens the X-frames in scissors-fashion and allows the frames to close in a similar fashion thereby raising and lowering the support.

16 Claims, 8 Drawing Sheets

LIFTING AND LOWERING APPARATUS

FIELD AND BACKGROUND OF THE INVENTION

The invention has been devised primarily for application to apparatus for raising and lowering a person, for use in caring for disabled, injured or infirm persons and for medical purposes, for example, for assisting a person to get into and out of a bath or up and down from and to the floor. Although the following description of the invention is directed mainly to this application of the invention, it is to be understood that there is no limitation in this regard as the invention is applicable to any appropriate type of apparatus for lifting and/or lowering persons or objects. Purely by way of example there may be mentioned apparatus for gaining access to elevated locations and apparatus for lifting and loading objects, for example lifting trolleys, lifting tables and pallet trunks.

According to the invention there is provided an apparatus for lifting or/and lowering persons or objects which comprises a structure provided with or adapted to be provided with a support for persons or/and objects, said structure having two parts which are movable relative to one another between an erected condition in which the support is in a raised position, and a collapsed condition in which the support is in a lowered position, and an inflatable means operatively connected between the parts of the structure so as to move said parts between the erected and collapsed conditions on inflation and deflation thereof.

Preferably the two parts of the structure are pivotally connected together. Preferably they are arranged in an X-configuration although other arrangements may be used, for example a number of pivoted links of any other appropriate configuration.

SUMMARY OF THE INVENTION

In a preferred embodiment of the invention the structure comprises two X-frames each comprising two members pivotally connected together at locations intermediate their ends, the two frames being disposed in planes parallel to one another and arranged, in use, to stand upright, the frames being connected together by one or more transverse members. However, other arrangements are possible within the scope of the invention, for example the structure may comprise only one such X-frame or three such X-frames disposed in spaced parallel relationship.

The inflatable means preferably comprises at least one inflatable bag extending between the two relatively movable parts of the structure.

Where the structure is of an X-configuration the bag is preferably formed with an opening and is arranged to surround the pivotal connection of the said two parts of the structure so that a portion of the bag lies between the two parts of the structure at one side of the pivotal connection and an opposed portion of the bag lies between the parts at the other side of the connection, whereby inflation and deflation of the bag, respectively, opens the structure in scissors-fashion and allows the structure to close in a similar fashion under the weight of a person or object on the support or just under the weight of the structure itself if there is no person or object on the support.

In the case of an apparatus having a single X-frame the bag will have only one, central opening but where the apparatus has two or more X-frames disposed in spaced parallel planes the bag may have a corresponding number of separate openings through which the respective frames extend or a single central opening containing all the frames. Thus, when there are separate openings the two opposed portions of the bag lying between the two relatively movable parts of the structure at opposite sides of the pivotal connection are connected together by a number of further portions of the bag which is one more than the number of openings in the bag.

The bag may be provided with tie means for connecting together the said two opposed portions of the bag at opposite sides of the or at least one opening in the bag. In the case of an apparatus having two or more X-frames in spaced parallel relationship, if the bag has only one central opening there may be just one such tie means extending across the opening, but if the bag has two or more openings a corresponding number of such tie means is preferably provided, one extending across each opening. The or each tie means may be two elongate elements connected to the respective portions of the bag and joined by a releasable connector which when released facilitates fitting of the bag to the structure and its removal. The tie means cause the bag to centre itself relative to the X-frames on inflation of the bag and prevent distortion of the bag which might otherwise cause an uneven application of forces by the bag to the parts of the structure on inflation of the bag and create strains in the structure of the bag.

The inflatable means may comprise a single bag or a number of bags.

In the case of an apparatus having a structure of X-configuration, for example one or more X-frames, the bags are preferably arranged in superimposed relationship. The bags may be arranged to be inflated and deflated simultaneously or one after the other.

The apparatus may further comprise means for producing a supply of compressed air, for example a pump or a compressed air cylinder, connected to the inflatable means and valve means for controlling the supply of air to the inflatable means and expulsion of air from the latter.

Alternatively the valve means may be connectible to an external source of compressed air.

The or each bag may be provided with internal or external restraint means adapted to limit the degree of permissible inflation of the bag and hence the height to which the support can be raised.

Where the structure is of X-configuration, one of the two parts thereof is preferably provided at its lower end with wheels, for example in the form of rollers or castors, arranged to run on a surface on which the apparatus is standing, towards and away from the lower end of the other part as the structure is moved between its erected and collapsed conditions, so that such movement takes place easily and smoothly. In this event, where the apparatus is to be used as a stationary apparatus, the lower end of said other part is preferably provided with means for preventing movement thereof relative to the said surface, for example non-slip feet or suction pads. Alternatively, where the apparatus may be required to be used to move persons or objects from place to place as well as lifting or/and lowering them, the lower end of said other part is preferably provided with wheels which may be equipped with braking means operable to prevent movement of the apparatus over the surface concerned on erection and collapsing of the structure.

The upper end of one of the parts of the structure may be provided with means for attachment to the support, and in this event the upper end of the other part is preferably provided with means adapted to permit it to slide or run along a lower surface of the support on erection and collapsing of the apparatus. These means may be sliders or wheels.

The support may simply comprise a platform of an appropriate size so that a person can sit and/or lie upon it. In other examples the support may be in the form of a seat or a stretcher which is detachable from the structure and which may also be combined with a platform, and for raising and lowering objects the support may likewise be a platform or of any other appropriate form such as a cradle or cage.

To enable the apparatus to lift and/or lower persons or objects to or from greater heights, it may be provided with one or more additional structures with inflatable means similar to the first structure and/or one or more additional structures similar to the first structure but without similar inflatable means, the structures being arranged one on top of the or each other so that they can be moved between their erected and collapsed conditions by movement of the said parts of the structure having inflatable means or of at least one of the structures having inflatable means between their erected and collapsed conditions under the control of said inflatable means, the structures being arranged one on top of the or each other. In the case of such an apparatus which has two or more structures with inflatable means, these inflatable means may be inflatable and deflatable together or independently.

Thus, where the structures comprise X-frames, the first structure may have pivotally connected to the upper ends of its frames the lower ends of the frames of a second structure, the upper ends of these frames either supporting the support or being similarly connected to a third structure which carries the support or is in turn similarly connected to one or more other such structures carrying the support.

BRIEF DESCRIPTION OF THE DRAWINGS

The invention will now be described, by way of example, with reference to the accompanying drawings, in which:-

DESCRIPTION OF THE PREFERRED EMBODIMENTS

Figure 1:
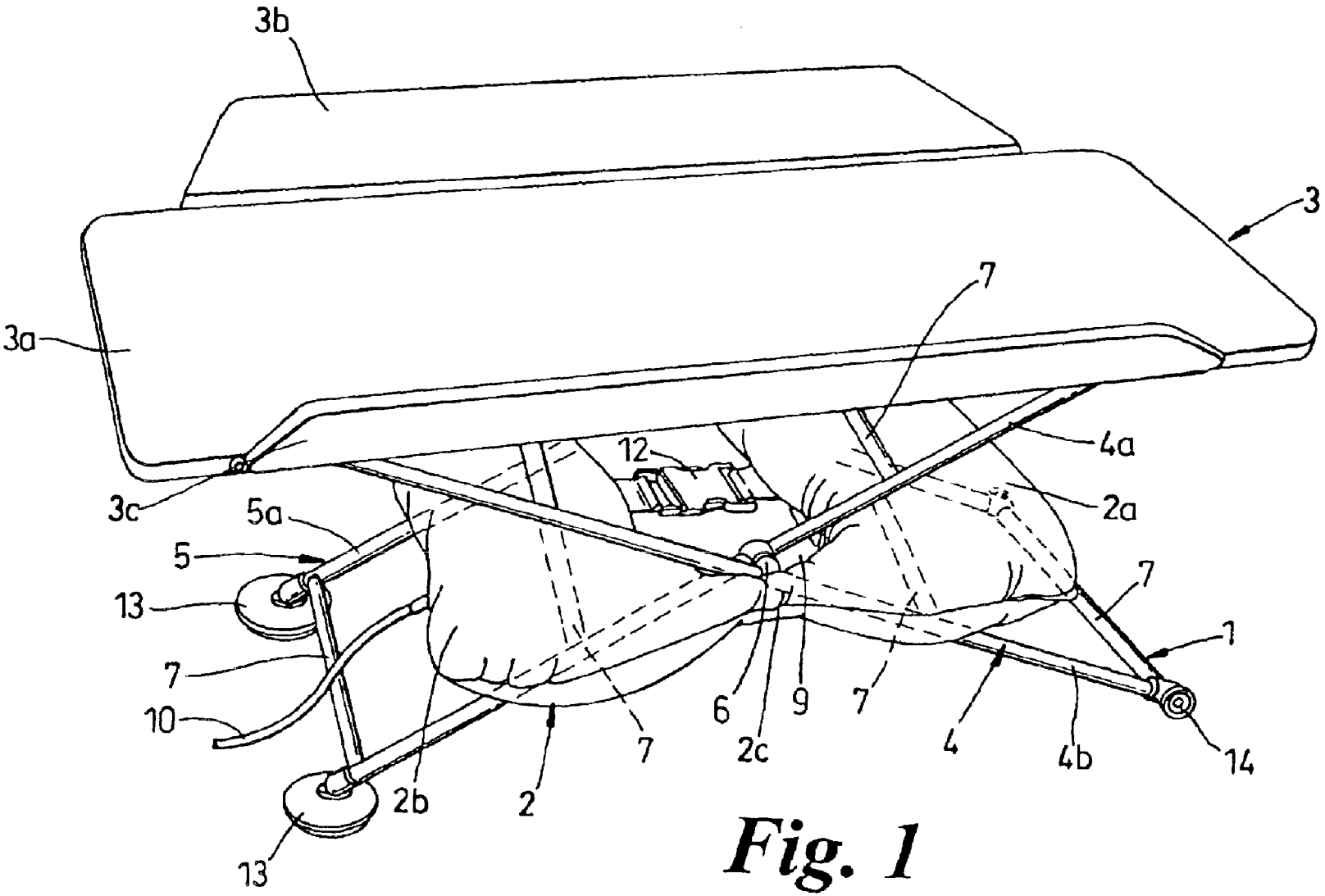
FIG. 1 is a perspective view of one form of apparatus according to the invention.
Figure 2:
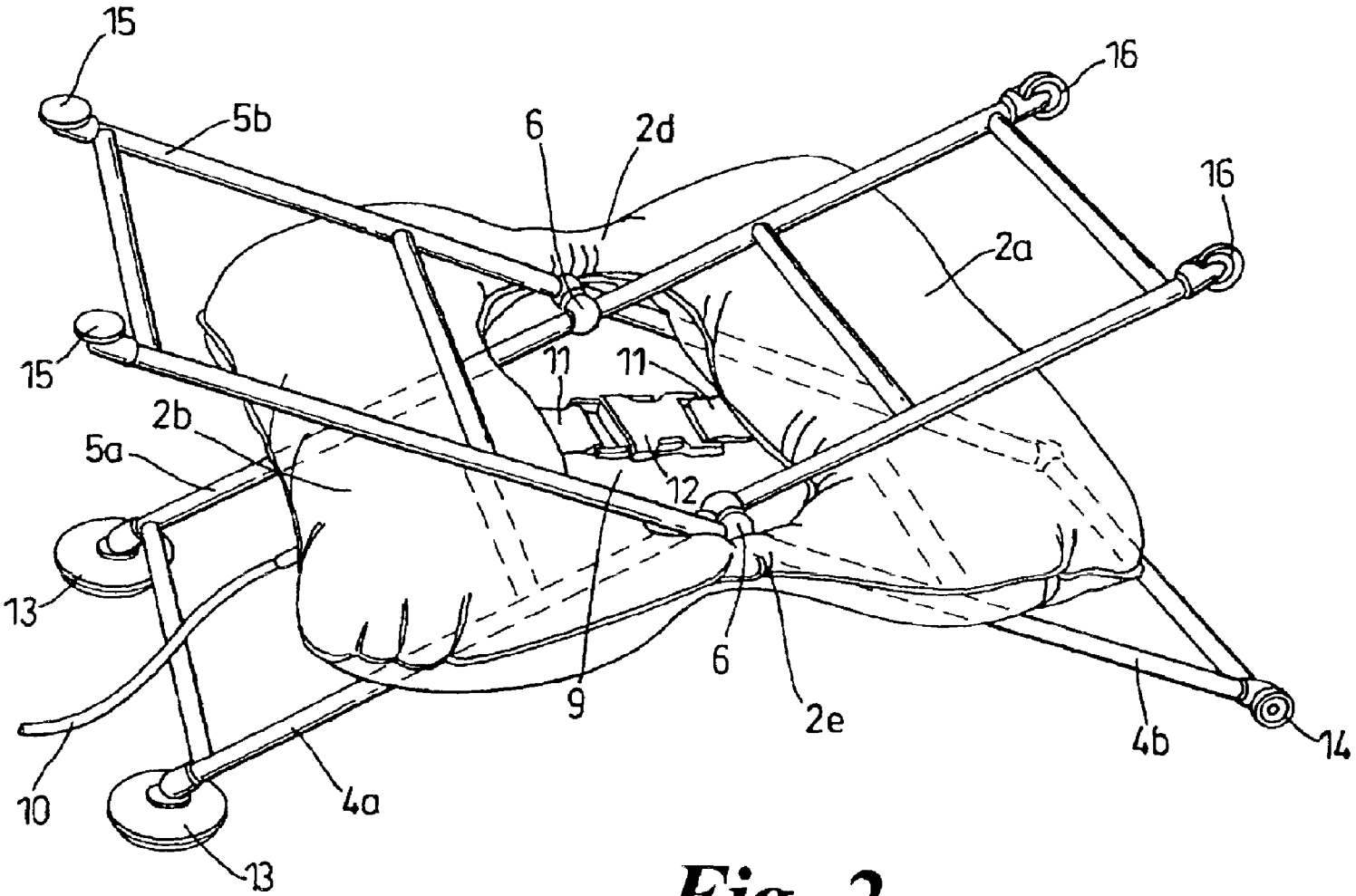
FIG. 2 is a similar view showing the apparatus of FIG. 1 without its support platform.
Figure 3:
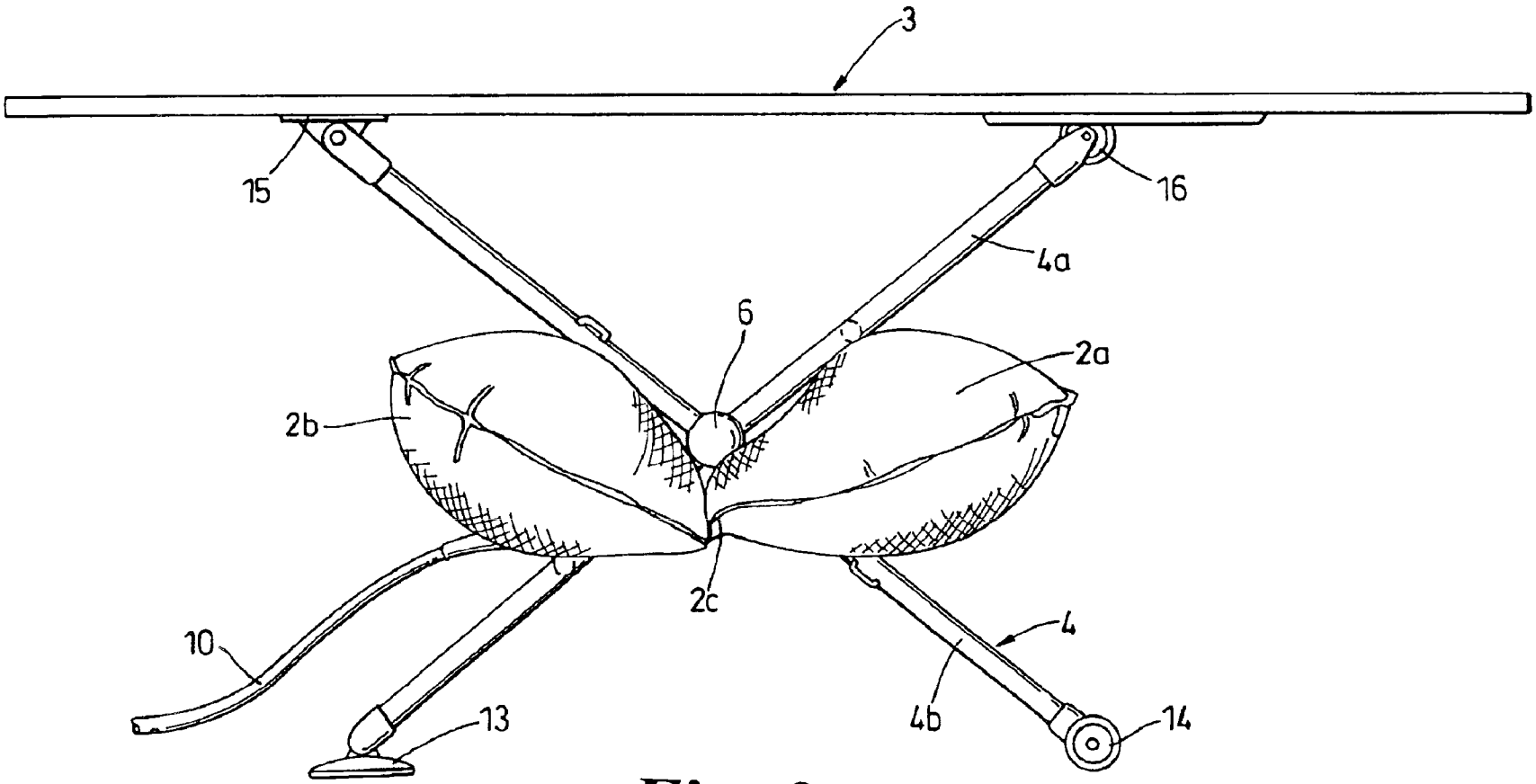
FIG. 3 is a side view of the apparatus of FIG. 1.

FIGS. 1 to 4 and FIGS. 5 to 7 of the drawings show two embodiments of an apparatus for raising and lowering a person which has been designed primarily for use in assisting a person to get into and out of a bath. Each apparatus comprises a structure generally designated 1 which is movable between erected and collapsed conditions, inflatable means 2 arranged on inflation and deflation thereof to erect the structure and collapse the structure respectively, and a support platform 3 supported by the structure on which a person may sit or lie to be raised or lowered, for example lifted out of or lowered into water in a bath (not shown).

In both embodiments the structure 1 comprises two X-frames 4,5, each comprising two elongate members 4*a*, 4*b* or 5*a*, 5*b* which are pivotally connected together intermediate their ends by a joint 6 so as to be movable relative to one another in scissors-fashion. The two frames are connected together in spaced parallel relationship by transverse members 7 so that in use they stand upright.

Figure 4:
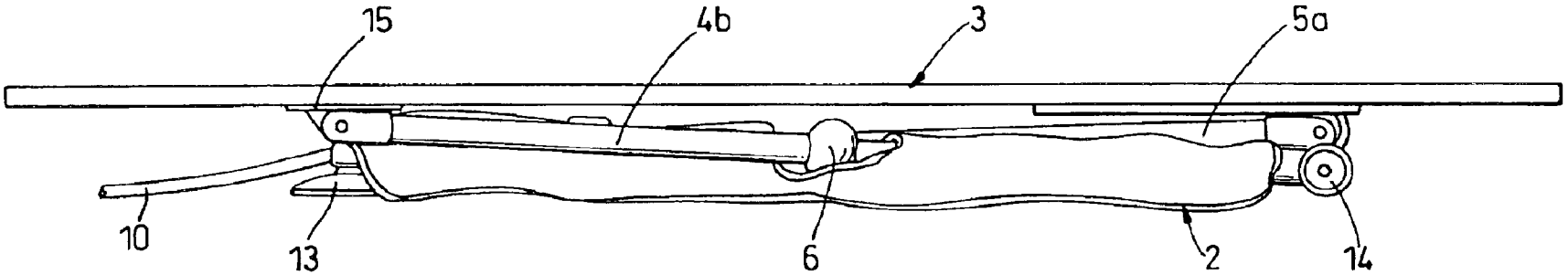
FIG. 4 is a side view showing the apparatus of FIG. 1 in a collapsed condition.
Figure 5:
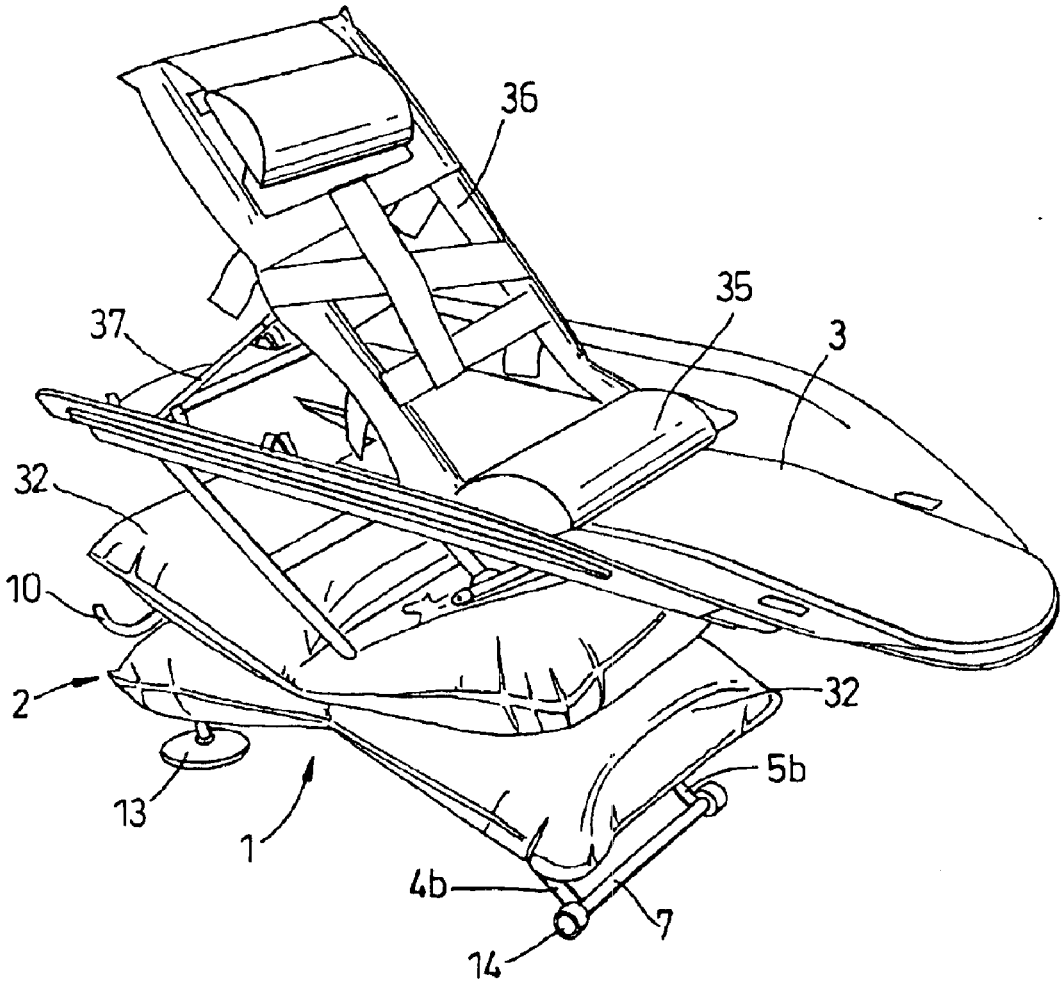
FIG. 5 is a perspective view of another form of apparatus embodying the invention.
Figure 6:
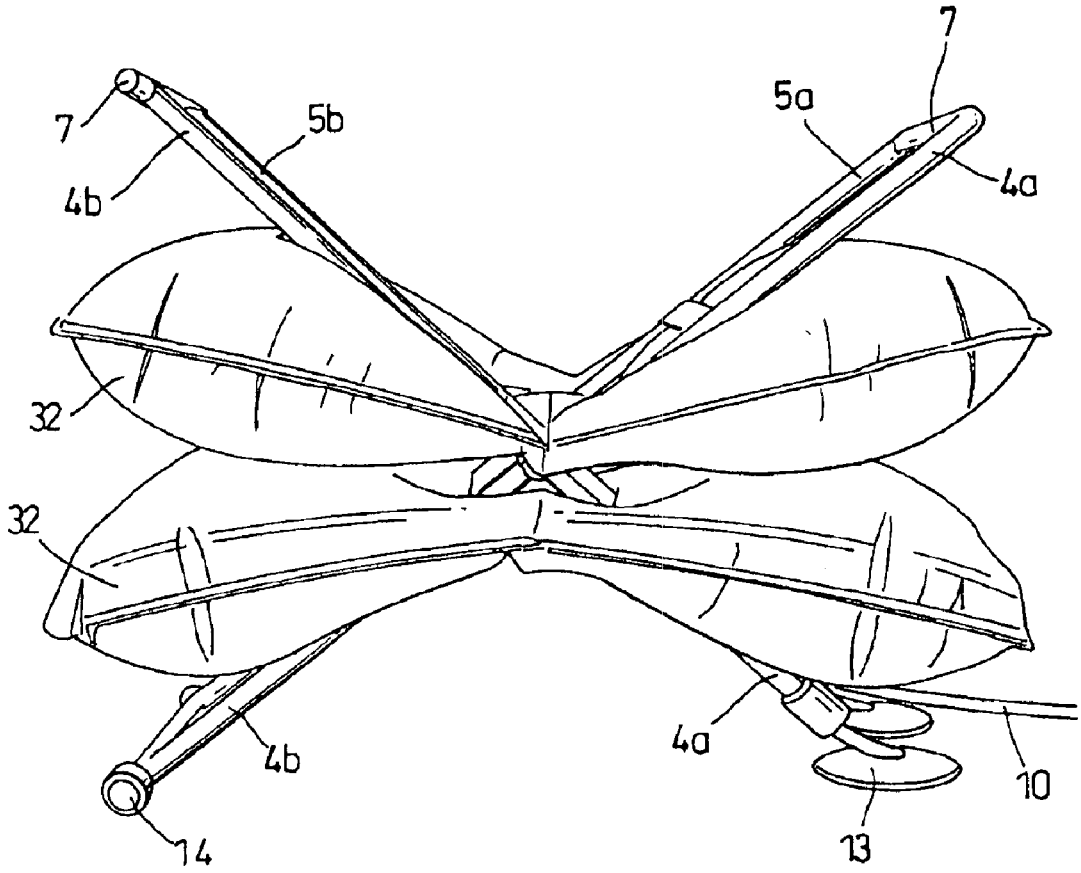
FIG. 6 is a side view of the apparatus of FIG. 5 without its support.
Figure 7:
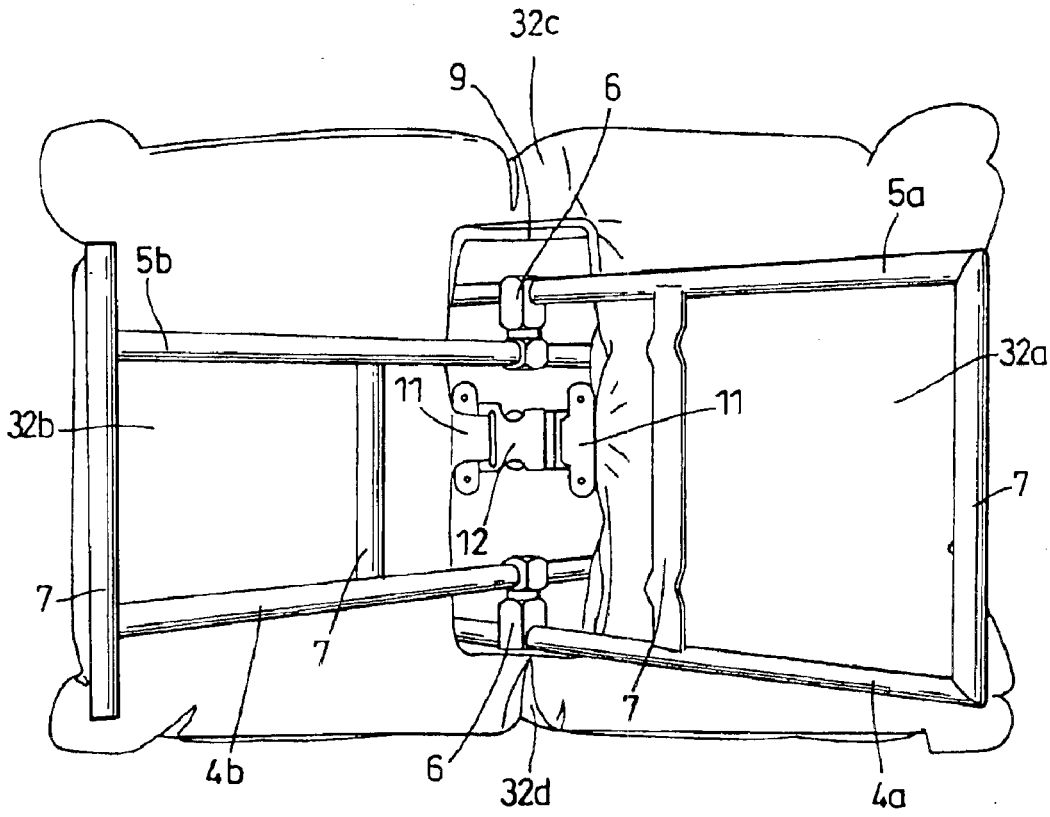
FIG. 7 is a plan view corresponding to FIG. 6, and FIGS. 8, 9 and 10 show diagrammatically three further forms of apparatus according to the invention.

In the embodiment of FIGS. 1 to 4 the inflatable means 2 comprises a single inflatable bag. This bag has a central opening 9 and comprises two relatively large sections 2*a*, 2*b* extending transversely of the apparatus and located between the members 4*a*, 4*b* and 5*a*, 5*b*, these sections being joined by smaller sections 2*c*, 2*d*. In the embodiment of FIGS. 5 to 7 the inflatable means 2 comprises two inflatable bags 32 arranged one on top of the other. Each bag has two relatively large sections 32*a*, 32*b* and two smaller sections 32*c*, 32*d* similar to the sections of the bag 2 in FIGS. 1 to 4. The internal compartments of the two bags communicate with one another so that air can flow between the bags.

The X-frames 4,5 extend through the central opening of the or each bag so that the latter surrounds the pivotal connections 6.

In both embodiments the inflatable means 2 is connected by a pipe 10 to a supply of compressed air which may be a separate unit supplied with the apparatus and comprising an air pump or compressed air cylinder. Valve means are provided to control the supply of compressed air to the bag and expulsion of air from the bag to inflate and deflate it.

The or each bag is formed from a number of pieces of plastics-coated material or plastics film which are joined together by welding or adhesive. Alternatively the bag may be blow-moulded in one piece.

The sections 2*a*, 2*b* or 32*a*, 32*b* of the bag (s) at opposite sides of the pivotal connection of the frames are connected together by a tie comprising two short belt lengths 11 joined by a buckle 12. This tie causes the bag to centre itself relative to the X-frames and prevents the or each bag becoming distorted as it is inflated and deflated thereby ensuring, in particular, that equal forces are applied to the frame members at opposite sides of the pivotal connection on inflation of the bag (s).

Also, the buckle can be released to enable the bag (s) to be fitted to the frames on assembly of the apparatus and removed from the frames, for example for storage purposes (alternatively the transverse members 7 could be detachable to facilitate fitting and removal of the bag in which case there may be a non-releasable tie between the sections 2*a*, 2*b* or 32*a*, 32*b* or between the sections 2*c*, 2*d* or 32*c*, 32*d*).

In both embodiments the lower ends of the frame members 4*a*, 5*a* are provided with two suction pads 13 for engagement with the bottom surface of a bath in order to hold the apparatus in position in the bath.

The lower ends of the members 4*b*, 5*b* are provided with wheels or rollers 14 arranged to run along the bottom surface of the bath as the structure 2 is moved between its erected and collapsed conditions. In the embodiment of FIGS. 1 to 4 the upper ends of the members 4*b*, 5*b* are provided with hinged plates 15 which engage the underside of the support platform 3 and may, if desired, be attached to it, for example by screws, welding or adhesive. The upper ends of the members 4*a*, 5*a* are provided with wheels or rollers 16 arranged to run along the underside of the platform on erection and collapsing of the structure 2.

In the embodiment of FIGS. 5 to 6 the transverse member 7 at the upper ends of the members 4*b*, 5*b* is secured to the underside of the support platform 3 and the ends of the transverse member 7 at the upper ends of the members 4*a*, 5*a* are provided with sliders arranged to run along the underside of the platform an erection and collapsing of the X-frames.

In the embodiment of FIGS. 1 to 4 the platform comprises a flat panel 3*a* with two side wings 3*b*, 3*c*. In FIGS. 5 to 7 the platform is of a similar design and is additionally provided with a seat 35 having a backrest 36 which is movable between a horizontal position and an inclined position as shown in FIG. 5 in which it is held by stays 37.

In use, the apparatus is placed in a bath and held in position by engagement of the suction pads 13 with the bottom surface of the bath.

The bag or bags is or are inflated by supplying compressed air to it or them so that expansion of the sections 2*a*, 2*b* or 32*a*, 32*b* causes the X-frames to open in scissors-fashion thereby raising the platform 3 to an erected condition level with the top of the bath. A person can then sit on the platform and swing his or her legs over the side of the bath on to the platform. Air is then released from the or each bag so that it deflates and allows the X-frames to close to a collapsed condition as shown in FIG. 4, thereby lowering the person into the bath. When the person has finished bathing the or each bag is inflated to raise the platform to the raised position so that he or she can then get out of the bath.

An advantage of the arrangement of the or each bag so that it surrounds the pivotal connection of the X-frames is that the bag acts as a barrier and keeps a user's limbs away from the scissors-type mechanism, thereby preventing, for example, a person's fingers being trapped between the X-frames as the apparatus is collapsed.

Figure 8:
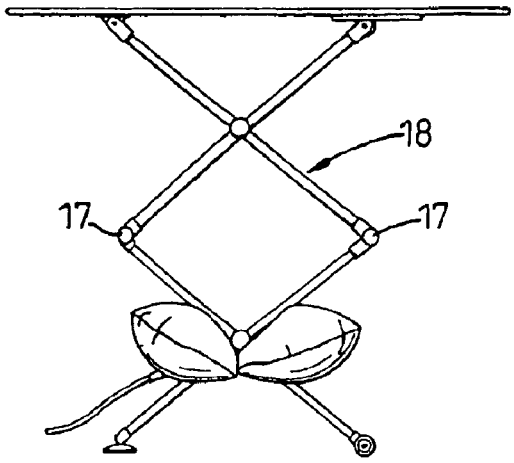
Figure 9:
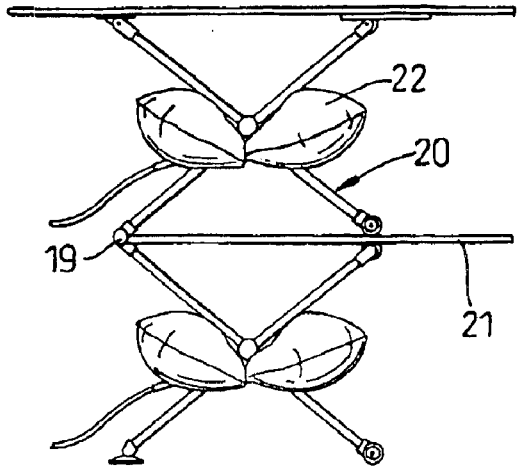
Figure 10:
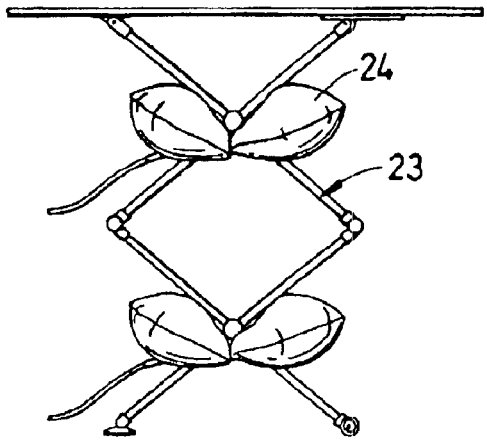

FIGS. 8,9 and 10 show three embodiments in the form of modified versions of the apparatus illustrated in FIGS. 1 to 4 and in which the same reference numerals are used to denote like parts.

In FIG. 8 an apparatus similar to that shown in FIGS. 1 to 4 has the support 3, the plates 15 and the wheels 16 replaced by pivotal connections 17 which connect the upper ends of the two X-frames 4,5 to the lower ends of the X-frames of a second structure 18 identical to the structure 1 but without an inflatable bag corresponding to the inflatable bag 2. This second structure has a support 3, plates 15 and wheels 16 identical to those of the apparatus shown in FIGS. 1 to 4. In this embodiment inflation and deflation of the bag 2 moves not only the X-frames 4,5 of the first structure 1 but also the X-frames of the second structure 18 (through the pivotal connections 17) between erected and collapsed conditions.

In FIG. 9 an apparatus similar to that shown in FIGS. 1 to 4 has the support 3 and the plate 15 replaced by pivotal connections 19 which connect the upper ends of the members 4*a*, 4*b* of the structure 1 to the lower ends of the members 4*a*, 4*b* of the X-frames of a second structure 20 similar to the structure 1, and a guide 21 similar to the platform 3 but attached to the pivotal connections 19 and extending between the wheels 16 of the first structure 1 and the wheels 14 of the second structure 20. In this case the second structure 20 has an inflatable bag 22. In this case, the two bags are inflated and deflated one after the other. To erect the two structures 1 and 20 the lower bag 2 is first inflated so that the lower structure 18 provides in its erected condition a rigid and stable base for the second structure 20 as it is then erected by inflating the upper bag 22. The apparatus is collapsed by first deflating the bag 22 of the upper structure 20 and then deflating the bag 2 of the lower structure 1. During these movements the wheels 16 of the first structure and the wheels 14 of the second structure run along the lower and upper surfaces of the guide 21.

The embodiment shown in FIG. 10 is similar to that illustrated in FIG. 8 except that the second structure designated 23 and corresponding to the structure 18 is provided with an inflatable bag 24.

In this embodiment the two bags are inflated and deflated together to raise and lower the platform 3.

The embodiments shown in FIGS. 8, 9 and 10 can be modified by replacing each single bag with two bags as in the embodiment of FIGS. 5 to 7.

It is to be understood that the scope of the present invention is not to be limited by the embodiment shown in the drawings. In particular, the apparatus may be made in a wide range of sizes to suit different uses.

Moreover, the invention includes any novel and inventive feature disclosed herein either alone or in combination with any one or more other such features.

What is claimed is:

1. An apparatus for lifting and/or lowering persons or objects which comprises a structure (1) provided with or adapted to be provided with a support (3) for persons and/or objects, said structure comprising two parts (4*a*,5*a* and 4*b*, 5*b*) which are pivotally connected together in an X-configuration so as to be movable relative to one another between an erected condition in which the support is in a raised position, and a collapsed condition in which the support is in a lowered position, and an inflatable means (2) arranged to act between the parts of the structure so as to move said parts between the erected and collapsed conditions on inflation and deflation thereof, characterized in that the inflatable means is formed with an opening through which the said parts (4*a*,5*a* and 4*b*,5*b*) of the structure (1) extend so that the inflatable means surrounds the pivotal connection (6) of the said two parts of the structure and a portion (2*a*) of the inflatable means lies between the two parts of the structure atone side of the pivotal connection and an opposed portion (2*b*) of the inflatable means lies between the parts at the other side of the connection, whereby inflation and deflation of the bag, respectively, opens the structure in scissors-fashion and allows the structure to close in a similar fashion.

2. An apparatus as claimed in claim 1 in which the structure comprises two X-frames (4,5) each comprising two members (4*a*, 4*b*, 5*a*, 5*b*) pivotally connected together at locations intermediate their ends, the two frames being disposed in planes parallel to one another and arranged, in use, to stand upright, the frames being connected together by one or more transverse members (7).

3. An apparatus as claimed in claim 1 in which the inflatable means (2) is detachable from the structure (1).

4. An apparatus as claimed in claim 2 in which the inflatable means (2) has a single, central opening (9) through which the frames (4,5) extend.

5. An apparatus as claimed in claim 1 in which the inflatable means (2) is provided with tie means (11,12) for connecting together the said two opposed portions (2*a*,2*b*) of the inflatable means at opposite sides of the opening (9) in the inflatable means.

6. An apparatus as claimed in claim 5 in which the tie means comprises two elongate elements (11) connected to the respective opposed portions of the inflatable means and joined by a releasable connector (12) which when released facilitates fitting of the inflatable means to the structure and its removal.

7. An apparatus as claimed in claim 1 in which the inflatable means comprises one or more inflatable bags.

8. An apparatus as claimed in claim 7 in which there are two or more bags (32) arranged in superimposed relationship.

9. An apparatus as claimed in claim 1 which further comprises means for producing or connectible to a supply of compressed air and connected to the inflatable means, and valve means for controlling the supply of air to the inflatable means and expulsion of air from the latter.

10. An apparatus as claimed in claim 7 in which the or each bag is provided with internal or external restraint means adapted to limit the degree of permissible inflation of the bag and hence the height to which the support (3) can be raised.

11. An apparatus as claimed in claim 1 in which one of the said two parts (4*a*, 5*a* and 4*b*, 5*b*) of the structure (1) is provided at its lower end with wheels, for example in the form of rollers or castors, arranged to run on a surface on which the apparatus is standing, towards and away from the lower end of the other part as the structure is moved between its erected and collapsed conditions.

12. An apparatus as claimed in claim 11 in which the lower end of said other part of the structure is provided with means for preventing movement thereof relative to the said surface, for example non-slip feet or suction pads.

13. An apparatus as claimed in claim 11 in which the upper end of one of the parts of the structure is provided with means for attachment to the support (3), the upper end of the other part being provided with means, for example sliders or wheels, adapted to permit it to slide or run along a lower surface of the support on erection and collapsing of the apparatus.

14. An apparatus as claimed in claim 1 in which the support (3) comprises a platform upon which a person can sit and/or lie, a seat or a stretcher which is detachable from the structure.

15. An apparatus as claimed in claim 1 which is provided with one or more additional structures with inflatable means similar to the first structure and/or one or more additional structures similar to the first structure but without similar inflatable means, the structures being arranged one on top of the or each other so that they can be moved between their erected and collapsed conditions by movement of the said parts of the structure having inflatable means or of at least one of the structures having inflatable means between their erected and collapsed conditions under the control of said inflatable means.

16. An apparatus as claimed in claim 15 in which the structure (1) has pivotally connected to the upper ends of its frames the lower ends of the frames of a said second structure, the upper ends of these frames either supporting the support (3) or being similarly connected to a said third structure which carries the support or is in turn similarly connected to one or more other such structures carrying the support.

* * * * *